US007371085B2

(12) United States Patent
Yonekawa

(10) Patent No.: US 7,371,085 B2
(45) Date of Patent: May 13, 2008

(54) CONNECTOR ATTACHMENT STRUCTURE FOR ELECTRONIC APPARATUS

(75) Inventor: Ryo Yonekawa, Daito (JP)

(73) Assignee: Funai Electric Co., Ltd., Daito-shi (JP)

( * ) Notice: Subject to any disclaimer, the term of this patent is extended or adjusted under 35 U.S.C. 154(b) by 0 days.

(21) Appl. No.: 11/447,197

(22) Filed: Jun. 6, 2006

(65) Prior Publication Data

US 2007/0066100 A1 Mar. 22, 2007

(30) Foreign Application Priority Data

Sep. 21, 2005 (JP) ..... 2005-274730

(51) Int. Cl.
*H01R 4/56* (2006.01)

(52) U.S. Cl. ..... 439/97; 439/108; 439/607

(58) Field of Classification Search ..... 439/97, 439/101, 108, 607
See application file for complete search history.

(56) References Cited

U.S. PATENT DOCUMENTS

| | | | | |
|---|---|---|---|---|
| 4,927,367 | A * | 5/1990 | Salvagno | 439/92 |
| 5,718,605 | A * | 2/1998 | Morikawa et al. | 439/607 |
| 6,728,110 | B2 * | 4/2004 | Koyama | 361/752 |
| 7,044,755 | B2 * | 5/2006 | Hatakeyama | 439/97 |
| 7,074,057 | B2 * | 7/2006 | Chiran et al. | 439/92 |
| 2007/0066100 | A1 * | 3/2007 | Yonekawa | 439/97 |

FOREIGN PATENT DOCUMENTS

| | | | |
|---|---|---|---|
| JP | 10-32047 | A | 2/1988 |
| JP | 2002-158065 | A | 5/2002 |
| JP | 2004-63336 | A | 2/2004 |
| JP | 2004-342697 | A | 12/2004 |

* cited by examiner

*Primary Examiner*—James Harvey
(74) *Attorney, Agent, or Firm*—Crowell & Moring LLP

(57) ABSTRACT

In a connector attachment structure of an electronic device, an immixture of a noise into a signal line by a static electricity is prevented by using a simple and inexpensive composition.

A connector attachment structure (10) is composed of a connector (11), a circuit board (12), a metal chassis (13), a connector setscrew (14), etc., and a metal shielding member (16) is disposed around a terminal (15) of a connector (11). A static electricity discharged to the shielding member (16) can be let off to the chassis (13) through the connector setscrew (14) by connecting the shielding member (16) to the chassis (13) through the connector setscrew (14) electrically, and the immixture of the noise into the signal line can be prevented as well as using an inexpensive-general screw.

7 Claims, 2 Drawing Sheets

CONNECTOR ATTACHMENT STRUCTURE FOR ELECTRONIC APPARATUS

BACKGROUND OF THE INVENTION

1. Field of the Invention

The present invention relates to a connector attachment structure for electronic apparatus, and especially relates to a connector attachment structure for protecting electronic components of the electronic apparatus from static electricity discharged to the connector when connecting a communication cable.

2. Description of the Related Art

In electronic apparatuses to which various kinds of communication cables are connected, various methods are conventionally proposed to protect electronic component of the electronic apparatus from static electricity discharged to a connector when a communication cable is connected thereto. For example, Japanese Laid-Open Patent Publication No. 2004-63336 discloses a connector attachment structure which prevents occurrence of noise by letting off the static electricity to a heat sink, chassis, or the like by covering whole of a circuit board with a large fireproof cover plate on an outer shell of an USB connector.

On the other hand, Japanese Laid-Open Patent Publication No. 2002-158065 discloses a connector shielding structure in which a PI board with an all-overlaying pattern is formed between a first shield covering a peripheral portion of a surface except an insertion face in a PI unit on the PI board and a second shield covering a peripheral portion of a rear surface.

Furthermore, Japanese Laid-Open Patent Publication No. 1998-32047 discloses a connector for IC card that a metal plate on a top face of the IC card is grounded through a plate spring member.

Still furthermore, Japanese Laid-Open Patent Publication No. 2004-342697 discloses a structure to remove static electricity for the purpose of preventing generation of noise caused by the static electricity when inserting and pulling out a printed circuit board with using a conductive attachment device.

However, the above mentioned conventional structures are unfit for inexpensive electronic apparatuses for consumers, because they need relatively costly exclusive components such as the fireproof cover plate, the plate spring member for grounding, the conductive attachment device, and so on, and thereby, expenses of them increase. In addition, the structure described in Japanese Laid-Open Patent Publication No. 2002-158065 needs the PI board to which the all over-laying pattern is added as well as the first and the second shields, and thereby, the unit cost of the PI board increases due to the increase of a number of components, so that the expense of the apparatus piles up.

SUMMARY OF THE INVENTION

The present invention is conceived to solve the above mentioned problems of the conventional structures, and an object of the present invention is to provide a connector attachment structure for electronic apparatus which can prevent mixture of noise due to static electricity into a signal line, although a simple and inexpensive composition.

A connector attachment structure for electronic apparatus in accordance with an aspect of the present invention comprises: a connector, to which a communication cable is connected, having terminals conductive to the cable, and a metal shielding member disposed around the terminals; a circuit board on which the connector is attached and signal lines conductive to the terminals are formed; a metal chassis supporting the circuit board; and at least a metal connector setscrew to fix the connector on the chassis. The metal shielding member is electrically connected to the chassis through the connector setscrew so that static electricity discharged to the shielding member is let off to the chassis through the connector setscrew, and immixture of noise into the signal lines on the circuit board is prevented.

According to such a constitution, since the shielding member is electrically connected to the metal chassis through the metal connector setscrew, the static electricity discharged to the shielding member can be let off to the chassis through the connector setscrew. Thus, the immixture of noise into the signal lines can be prevented as well as using inexpensive and general screw as the connector setscrew. Furthermore, the shielding member can be directly fixed on the chassis by fastening the connector setscrew on the chassis, so that the connector can be tightly fixed on the chassis and radiation of noise to the terminals of the connector can be prevented.

While the novel features of the present invention are set forth in the appended claims, the present invention will be better understood from the following detailed description taken in conjunction with the drawings.

BRIEF DESCRIPTION OF THE DRAWINGS

The present invention will be described hereinafter with reference to the attached drawings. It is to be noted that all the drawings are shown for the purpose of illustrating the technical concept of the present invention or embodiments thereof, wherein.

DESCRIPTION OF THE PREFERRED EMBODIMENTS

First Embodiment

Figure 1:
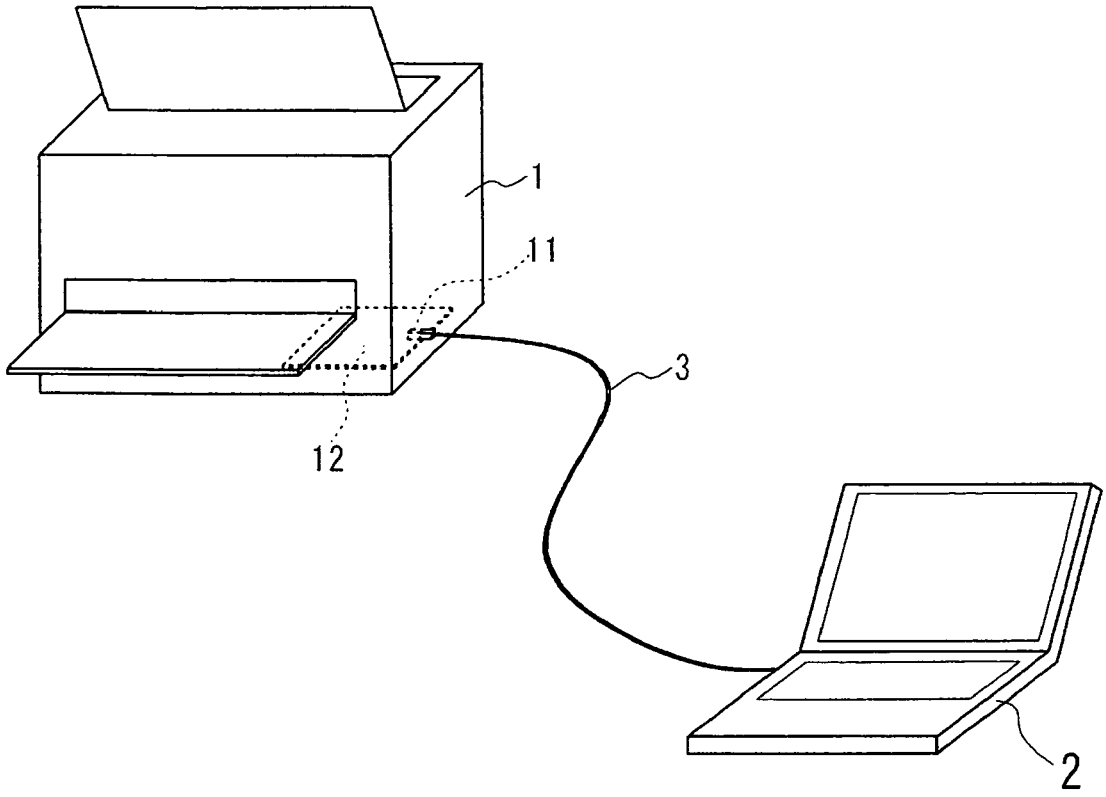
FIG. 1 is a perspective view showing a connection state of an image forming device which is an example of an electronic device in accordance with an embodiment of the present invention to a computer device.

An electronic device comprising a connector attachment structure in accordance with a first embodiment of the present invention is described with reference to the drawings. FIG. 1 illustrates an image forming device which is an example of the electronic device in accordance with the present invention.

The image forming device 1 is a device for forming an image on a recording paper sheet responding to a command outputted from a computer device 2 such as a personal computer. The image forming device 1 and the computer device 2 are normally connected with each other through a communication cable 3 such as an USB communication cable. Therefore, the image forming device 1 includes a connector 11 to which the communication cable 3 is connected and a circuit board 12 on which the connector 11 is attached. Besides, since an image forming unit and a recording paper transportation unit not illustrated in FIG. 1 are no different from those of the conventional ones, descriptions of them are omitted.

Figure 2:
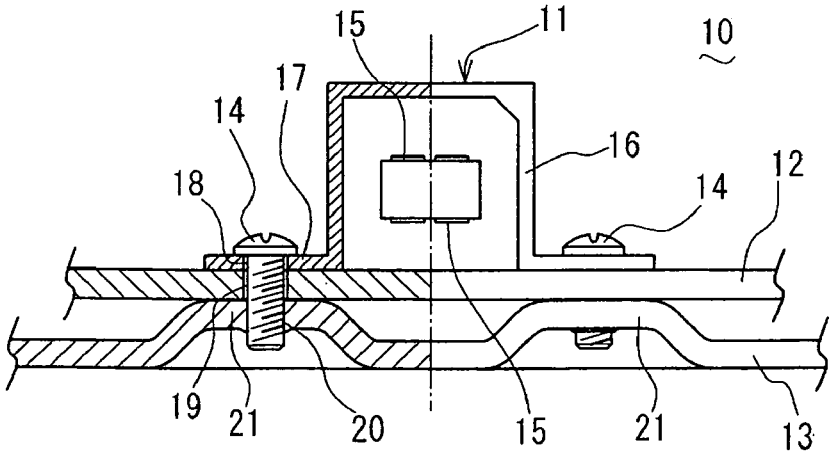
FIG. 2 is a half sectional view showing a connector attachment structure in accordance with the embodiment of the present invention.

FIG. 2 illustrates a connector attachment structure 10 to attach the connector 11 on the circuit board 12. The connector attachment structure 10 is comprised of the connector 11 and the circuit board 12 described above, a chassis 13 supporting the circuit board 12, a connector setscrew 14 to fix the connector 11 on the chassis 13, and so on. Aluminum etc., for example, may be included as for a member of the chassis 13, and metals such as iron etc., for example, may be included for a member of the connector setscrew 14, respectively.

The connector 11 includes a plurality of terminals 15 to which the communication cable 3 is connected and a shielding member 16 disposed around the terminal 15. The shielding member 16 is formed by sheet metal processing so as to shield an electric field. Various signal line patterns including signal lines conductive to the terminals 15 are formed in the circuit board 12.

A screw cramp portion 17, to which the connector setscrew 14 is attached, is formed on a bottom portion of the shielding member 16 so as to protrude outward from the connector 11 observed in planar, that is, to face the circuit board 12. Screw insertion holes 18 and 19, into which the connector setscrew 14 is inserted, are formed in the screw cramp portion 17 and the circuit board 12, respectively.

A internal threads 20, to which the connector setscrew 14 penetrating through the screw insertion holes 18 and 19 is engaged, is formed on the chassis 13. Moreover, a peripheral portion 21 of the internal threads 20 is formed to protrude toward the circuit boars 12 by sheet metal processing, or the like, so that it is contacted with the circuit board 12. In this manner, since only the peripheral portion 21 of the internal threads 20 is formed to protrude toward the circuit board 12, portions except for the peripheral portion 21 of the internal threads 20 of the chassis 13 are isolated from the circuit board 12 at predetermined distance without placing a spacer having insulation characteristic between the chassis 13 and the circuit board 12 separately. Thereby, a short-circuit caused by contact between soldered portion on the circuit board 12 or a front end of each terminal of various electronic components which are attached on the circuit board and the chassis 13 is prevented.

As described above, according to the connector attachment structure 10 of the first embodiment, the shielding member 16 is electrically connected to the metal chassis 13 through the connector setscrew 14 made of a metal, so that the static electricity discharged to the shielding member 16 can be let off to the chassis 13 through the connector setscrew 14. Thereby, since it is no need to provide an earth line near to the signal line on the circuit board 12, the immixture of noise into the signal line can be prevented as well as using the inexpensive and general screw as the connector setscrew 14.

Furthermore, the screw cramp portion 17 is formed on the bottom portion of the shielding member 16 so as to protrude outward from the connector 11 observed in planar, that is, to face the circuit board 12, the screw insertion holes 18 and 19 are formed in the screw cramp portion 17 and the circuit board 12, and the internal threads 20 are formed on the chassis 13, respectively. Therefore, the shielding member 16 and the circuit board 12 can be tightly fixed on the chassis 13 by fastening the connector setscrew 14. As a result, it is possible to prevent the radiation of noise from a noise source of a body of the image forming device 1 to the terminal 15 of the connector 11.

Still furthermore, even when a large force is acted on the shielding member 16 of the connector 11 while connecting the communication cable 3, a stress applied to the circuit board 12 can be dispersed to the chassis 13, so that deformation of the circuit board 12 can be prevented, and thereby damage of the circuit board 12 can be prevented.

Still furthermore, the internal threads 20, to which the connector setscrew 14 is engaged, is formed on the chassis 13, so that fastening member such as a screw nut becomes unnecessary, and thereby a number of the components can be lessened and assembly operation can be performed rapidly and easily.

Second Embodiment

Figure 3:
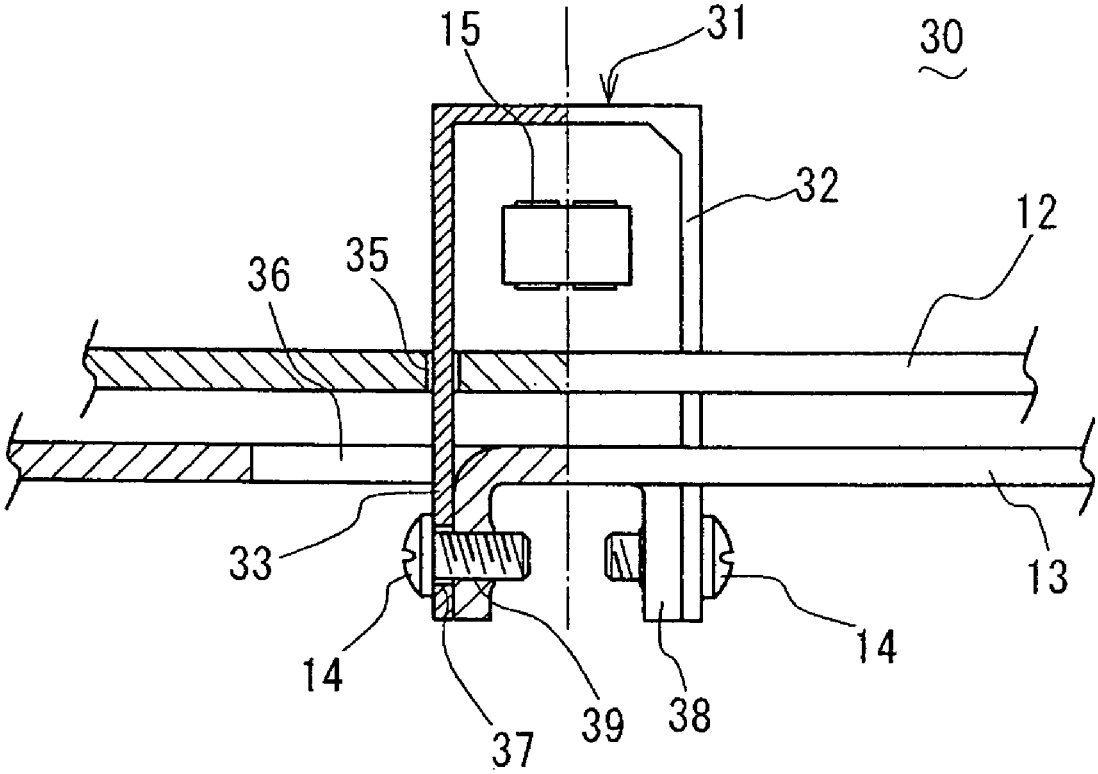
FIG. 3 is a half sectional view showing a connector attachment structure in accordance with another embodiment of the present invention.

Subsequently, a connector attachment structure 30 in accordance with a second embodiment of the present invention is described with reference to FIG. 3. The second embodiment is different from the above mentioned first embodiment in that a pair of screw cramp portions 33 extends toward the chassis 13 from both side faces of a shielding member 32 of a connector 31 facing each other so as to penetrate through the circuit board 12 and the chassis 13. Furthermore, through-holes 35 and 36, through which the screw cramp portions 33 extended as described above penetrates, are formed on the circuit board 12 and the chassis 13, respectively.

A screw insertion hole 37, into which the connector setscrew 14 is inserted, is formed on each of the screw cramp portions 33. Furthermore, a pair of screw engagement portions 38 is formed by cutting the chassis 13 and bent the cut portion precipitously to face the screw cramp portions 33 when the screw cramp portions 33 are inserted into and penetrate through the insertion holes 35 and 36 of the chassis 13. The insertion holes 36 and the screw engagement portions 38 of the chassis 13 are formed by sheet metal processing. Still furthermore, an internal thread 39, with which the connector setscrew 14 inserted into the screw insertion holes 37 is engaged, is formed on each of the screw engagement portions 38.

As described above, according to the connector attachment structure 30 of the second embodiment, in the same manner as the above first embodiment, since the shielding member 32 is electrically connected to the chassis 13 made of a metal through the connector setscrew 14 made of a metal, it is no need to provide an earth line near to the signal line on the circuit board 12, and immixture of noise into the signal line can be prevented as well as using the inexpensive and general screw as the connector setscrew 14.

Furthermore, in the same manner as the first embodiment, the internal thread 39, to which the connector setscrew 14 is engaged, is formed in the chassis 13, so that fastening member such as a screw nut becomes unnecessary, and then a number of components can be lessen and assembly operation can be performed rapidly and easily.

Still furthermore, the screw cramp portion 33 is formed to extend toward the chassis 13 from a part of the side face of the shielding member 32, the screw insertion holes 35 and 36, into which the screw cramp portions 33 are inserted, are formed on the circuit board 12 and the chassis 13, respectively, and the screw engagement portion 38 is formed on the chassis 13 so as to face the screw cramp portion 33. Therefore, the shielding member 32 can be directly fixed on the chassis 13 by fastening the connector setscrew 14. As a result, the connector 31 can be tightly fixed on the chassis 13 and radiation of noise from a noise source of the body of the image forming device 1 to the terminals 15 of the connector 31 can be prevented.

Still furthermore, since the shielding member 32 and the chassis 13 are not directly connected with each other, even when a large force is acted on the shielding member 32 while connecting the communication cable 3, no large stress is generated in the circuit board 12, so that the circuit board 12 may not be damaged.

Still furthermore, the screw cramp portions 33 extend from the side faces of the shielding member 32 facing each other toward the chassis 13, so that the connector 31 can be fixed on the chassis 13 more tightly.

Still furthermore, since each of the screw cramp portion 33 is formed by extending a part of the side face of the shielding member 32 toward the chassis 13, even when there is not enough space for forming the screw insertion hole 18 (refer to FIG. 2 in the first embodiment) around the connector 31 due to a design of the circuit, the connector 31 and the chassis 13 can be tightly connected with each other through the connector setscrew 14.

Besides, the present invention is not limited to the constitution in the above mentioned embodiments, it is only necessary to connect the shielding member of the connector to the chassis through the connector setscrew, electrically. Furthermore, the present invention can be varied in various manner, and the communication cable 3 used for a connection to the computer device 2 or the like is not limited to the USB communication cable, however, communication cables pursuant to IEEE 1394 standard or communication cables pursuant to LAN standard such as Ethernet (Registered Trademark) etc., for example, can also be adopted. Still furthermore, the connector attachment structures 10 and 13 of the present invention are not limited to the image forming device 1, however, they can be adopted by various electronic devices having a connector to which the communication cable 3 is connected.

The present invention is not limited to the constitutions of the above-mentioned embodiments, and it is sufficient that a connector attachment structure for electronic apparatus comprises: a connector, to which a communication cable is connected, having terminals conductive to the cable, and a metal shielding member disposed around the terminals; a circuit board on which the connector is attached and signal lines conductive to the terminals are formed; a metal chassis to support the circuit board; and at least a metal connector setscrew to fix the connector on the chassis, and wherein the metal shielding member is electrically connected to the chassis through the connector setscrew so that static electricity discharged to the shielding member is let off to the chassis through the connector setscrew, and immixture of noise into the signal lines on the circuit board is prevented.

According to such a constitution, since the shielding member is electrically connected to the metal chassis through the metal connector setscrew, the static electricity discharged to the shielding member can be let off to the chassis through the connector setscrew. Thus, the immixture of noise into the signal lines can be prevented as well as using inexpensive and general screw as the connector setscrew. Furthermore, the shielding member can be directly fixed on the chassis by fastening the connector setscrew on the chassis, so that the connector can be tightly fixed on the chassis and radiation of noise to the terminals of the connector can be prevented.

In the above mentioned constitution, it is possible to constitute that the shielding member is formed by sheet metal processing, and has at least a screw cramp portion formed to protrude outward from a lower end thereof; screw insertion holes, into which the connector setscrew is inserted, are formed on the screw cramp portion of the shielding member and at a portion of the circuit board facing the screw cramp portion when the connector is attached on the circuit board, respectively; and at least an internal thread is formed at a portion on the chassis facing the screw insertion holes when the circuit board with the connector is disposed on the chassis.

According to such a constitution, the shielding member and the circuit board can be tightly fixed on the chassis by fastening the connector setscrew with the internal thread formed on the chassis. Furthermore, radiation of noise from the circuit board to the terminals of the connector can be prevented. Still furthermore, even when a large force is acted on the shielding member when the communication cable is connected to the connector, deformation of the circuit board can be prevented by dispersing a stress applied to the circuit board to the chassis, and thereby the circuit board may not be damaged. Still furthermore, since the internal thread, with which the connector setscrew is engaged, is formed on the chassis, no fastening member such as a screw nut is necessary, and thereby a number of components constituting the connector attachment structure can be lessened and assembly operation of the connector attachment structure can be performed rapidly and easily.

Furthermore, it is possible to constitute that the portion of the chassis where the internal thread is formed is protruded toward the circuit board from other portions of the chassis. With such a configuration, since only a peripheral portion of the internal threads is formed to protrude toward the circuit board, portions except for the peripheral portion of the internal threads of the chassis are isolated from the circuit board at predetermined distance without placing a spacer having insulation characteristic between the chassis and the circuit board separately. Thereby, a short-circuit caused by contact between soldered portion on the circuit board or a front end of each terminal of various electronic components which are attached on the circuit board and the chassis is prevented.

Alternatively, it is possible to constitute that the shielding member is formed by sheet metal processing, and has at least a screw cramp portion formed to extend toward the chassis from a part of a side face thereof; a screw insertion hole, into which the connector setscrew is inserted, is formed on the screw cramp portion of the shielding member; through-holes, through which the screw cramp portion penetrates, are formed on the circuit board and the chassis, respectively; at least a screw engagement portion is formed on the chassis precipitously to face the screw cramp portion when the screw cramp portion penetrates through the through-hole of the chassis; and an internal thread, with which the connector setscrew inserted into the screw insertion hole is engaged, is formed on the screw engagement portion.

According to such a constitution, the shielding member can be directly fixed on the chassis by fastening of the connector setscrew, and thereby, the connector can be tightly fixed on the chassis and the radiation of the noise to the connector terminal can be prevented. Furthermore, since the shielding member and the circuit board are not connected with each other, even when a large force is put on the shielding member when connecting the communication cable, the large stress is not put on the circuit board, and the damage of the circuit board can be prevented. Still furthermore, since the screw cramp portion is formed by extending a part of the side face of the shielding member toward the chassis, even when there is not enough space for setting the screw insertion hole around the connector due to a design of the circuit, the connector and the chassis can be tightly connected with each other through the connector setscrew. Still furthermore, since the internal thread, with which the connector setscrew is engaged, is formed on the chassis, no fastening member such as a screw nut is necessary, and thereby a number of components constituting the connector attachment structure can be lessened and assembly operation of the connector attachment structure can be performed rapidly and easily.

This application is based on Japanese patent application 2005-274730 filed Sep. 21, 2005 in Japan, the contents of which are hereby incorporated by references.

Although the present invention has been fully described by way of example with reference to the accompanying drawings, it is to be understood that various changes and modifications will be apparent to those skilled in the art. Therefore, unless otherwise such changes and modifications depart from the scope of the present invention, they should be construed as being included therein.

What is claimed is:

1. A connector attachment structure for electronic apparatus comprising:

a connector, to which a communication cable is connected, having terminals conductive to the cable, and a metal shielding member disposed around the terminals;

a circuit board on which the connector is attached and signal lines conductive to the terminals are formed, the metal shielding member contacting non conductive portions of the circuit board and being distant from conductive portions thereof;

a metal chassis to support the circuit board; and at least a metal connector setscrew to fix the connector on the chassis; wherein the metal shielding member is electrically connected to the chassis through the connector setscrew so that static electricity discharged to the shielding member is let off to the chassis through the connector setscrew, and immixture of noise into the signal lines on the circuit board is prevented.

2. The connector attachment structure for electronic apparatus in accordance with claim 1, wherein the shielding member is formed by sheet metal processing, and has at least a screw cramp portion formed to protrude outward from a lower end thereof;

screw insertion holes, into which the connector setscrew is inserted, are formed on the screw cramp portion of the shielding member and at a portion of the circuit board facing the screw cramp portion when the connector is attached on the circuit board, respectively; and at least an internal thread is formed at a portion on the chassis facing the screw insertion holes when the circuit board with the connector is disposed on the chassis.

3. The connector attachment structure for electronic apparatus in accordance with claim 2, wherein the portion of the chassis where the internal thread is formed is protruded toward the circuit board from other portions of the chassis.

4. The connector attachment structure for electronic apparatus in accordance with claim 1, wherein the shielding member is formed by sheet metal processing, and has at least a screw cramp portion formed to extend toward the chassis from a part of a side face thereof;

a screw insertion hole, into which the connector setscrew is inserted, is formed on the screw cramp portion of the shielding member;

through-holes, through which the screw cramp portion penetrates, are formed on the circuit board and the chassis, respectively;

at least a screw engagement portion is formed on the chassis precipitously to face the screw cramp portion when the screw cramp portion penetrates through the through-hole of the chassis; and an internal thread, with which the connector setscrew inserted into the screw insertion hole is engaged, is formed on the screw engagement portion.

5. The connector attachment structure for electronic apparatus in accordance with claim 4, wherein the screw engagement portion is formed by cutting the chassis and bent the cut portion precipitously in an opposite direction to the circuit board.

6. An electronic apparatus connected to another apparatus via a communication cable and having a connector attachment structure, wherein the connector attachment structure comprises:

a connector, to which a communication cable is connected, having terminals conductive to the cable, and a metal shielding member disposed around the terminals, the shielding member having at least a screw cramp portion formed to protrude outward from a lower end thereof and at least a screw insertion hole, into which a connector setscrew is inserted, formed on the screw cramp portion;

a circuit board on which the connector is attached and signal lines conductive to the terminals are formed, and having at least a screw insertion hole, into which the connector setscrew is inserted, formed at a portion facing the screw cramp portion when the connector is attached on the circuit board, the metal shielding member contacting non conductive portions of the circuit board and being distant from conductive portions thereof;

a metal chassis to support the circuit board and having at least an internal thread formed at a position facing the screw insertion holes when the circuit board with the connector is disposed thereon; and at least a metal connector setscrew to fix the connector on the chassis, thereby a static electricity discharged to the shielding member is let off to the chassis through the connector setscrew by connecting the shielding member to the chassis through the connector setscrew electrically, and an immixture of a noise into a signal line of the circuit board is prevented.

7. An electronic apparatus connected to anther apparatus via a communication cable and having a connector attachment structure, wherein the connector attachment structure comprises:

a connector, to which a communication cable is connected, having terminals conductive to the cable, and a metal shielding member disposed around the terminals, the shielding member having at least a screw cramp portion formed to extend toward the chassis from a part of a side face thereof and a screw insertion hole, into which the connector setscrew is inserted, formed on the screw cramp portion;

a circuit board on which the connector is attached and signal lines conductive to the terminals are formed, and having at least a through-hole, through which the screw cramp portion penetrates, the metal shielding member contacting non conductive portions of the circuit board and being distant from conductive portions thereof;

a metal chassis to support the circuit board and having at least a through-hole, through which the screw cramp portion penetrates, at least a screw engagement portion formed precipitously to face the screw cramp portion when the screw cramp portion penetrates through the through-hole thereof, and an internal thread formed on the screw engagement portion at a position facing the screw insertion hole when the circuit board with the connector is disposed thereon; and at least a metal connector setscrew to fix the connector on the chassis, thereby a static electricity discharged to the shielding member is let off to the chassis through the connector setscrew by connecting the shielding member to the chassis through the connector setscrew electrically, and an immixture of a noise into a signal line of the circuit board is prevented.

* * * * *